US006001475A

United States Patent [19]

Hsu

[11] Patent Number: 6,001,475

[45] Date of Patent: Dec. 14, 1999

[54] SILVER-CONTAINING POLY(P-PHENYLENE TEREPHTHALAMIDE)/SULFONATED POLYANILINE COMPOSITE FIBERS

[75] Inventor: Che-Hsiung Hsu, Wilmington, Del.

[73] Assignee: E. I. du Pont de Nemours and Company, Wilmington, Del.

[21] Appl. No.: 09/175,258

[22] Filed: Oct. 20, 1998

[51] Int. Cl.[6] ..... D02G 3/00

[52] U.S. Cl. ..... 428/370; 428/372; 428/373

[58] Field of Search ..... 428/370, 372, 428/373, 395

[56] References Cited

U.S. PATENT DOCUMENTS

| | | | |
|---|---|---|---|
| 5,248,554 | 9/1993 | Hsu | 428/395 |
| 5,302,415 | 4/1994 | Gabara et al. | 427/306 |
| 5,460,881 | 10/1995 | Hsu | 428/357 |
| 5,549,972 | 8/1996 | Hsu et al. | 428/398 |
| 5,788,897 | 8/1998 | Hsu | 264/184 |
| 5,882,566 | 3/1999 | Hsu et al. | 428/364 |

FOREIGN PATENT DOCUMENTS

| | | | |
|---|---|---|---|
| 0 355 518 | 2/1990 | European Pat. Off. | D01F 11/04 |
| 97/22740 | 6/1997 | WIPO | D01F 6/90 |

*Primary Examiner*—Newton Edwards

[57] ABSTRACT

Silver-containing fibers are disclosed having silver particles intermingled with domains of sulfonated polyaniline in a continuous phase of poly(p-phenylene terephthalamide).

5 Claims, 2 Drawing Sheets

SILVER-CONTAINING POLY(P-PHENYLENE TEREPHTHALAMIDE)/SULFONATED POLYANILINE COMPOSITE FIBERS

BACKGROUND OF THE INVENTION

1. Field of the Invention

This invention relates to silver-containing, high tenacity, high modulus, electrically-conductive composite fibers of poly(p-phenylene terephthalamide) (PPD-T) and sulfonated polyaniline (SPAn).

2. Description of the Prior Art

U.S. Pat. No. 5,302,415 issued on Apr. 12, 1994 discloses treatment of aramid fibers in concentrated sulfuric acid to increase adhesion of metal electrolessly plated thereon.

U.S. Pat. No. 5,549,972, issued Aug. 27, 1996, discloses a process wherein silver plating is conducted on fibers of PPD-T having less than 20 weight percent water and greater than 0.5 weight percent sulfur based on the total weight of the PPD-T.

U.S. Pat. No. 5,788,897, issued Aug. 4, 1998, discloses a method to prepare high tenacity, high modulus conductive fibers of PPD-T and SPAn.

SUMMARY OF THE INVENTION

This invention provides a composite, silver-containing, fiber having a longitudinal axis and comprising a continuous phase of poly(p-phenylene terephthalamide) and, interspersed therein, domains of sulfonated polyaniline aligned substantially parallel with the longitudinal axis wherein the sulfonated polyaniline is present in an amount of 2 to 35 weight percent based on the combined weight of the sulfonated polyaniline and the poly(p-phenylene terephthalamide) and wherein silver particles are intermingled with the domains of sulfonated polyaniline and silver is present in an amount of 15 to 70 weight percent based on the total weight of the composite, silver-containing, fibers. The silver particles can be interspersed throughout the entire fiber or they can be present in a zone of impregnation at the outer periphery of the fiber structure; and the fibers can be plated on the surface with a continuous layer of silver.

conductive, the conductivity of the instant fibers is primarily a result of silver present in the fibers. Silver particles are present in the fibers of this invention intermingled with the SPAn. SPAn is dispersed as elongated domains aligned substantially parallel with the axis of the composite fibers and silver particles are intermingled with the domains of SPAn in that same alignment.

By "poly(p-phenylene terephthalamide)" (PPD-T), is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that other diamines and diacid chlorides have no reactive groups which interfere with the polymerization reaction. PPD-T, also, means copolymers resulting from incorporation of other aromatic diamines and other aromatic diacid chlorides, such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

Additives can be used with the PPD-T and it has been found that up to as much as 10 percent, by weight, of other polymeric material can be blended with the PPD-T or that copolymers can be used having as much as 10 percent of other diamine substituted for the diamine of the PPD-T or as much as 10 percent of other diacid chloride substituted for the diacid chloride of the PPD-T.

By "sulfonated polyaniline" (SPAn), is meant polyaniline with a sulfonic acid attached to at least one repeating ring. SPAn can be represented as follows:

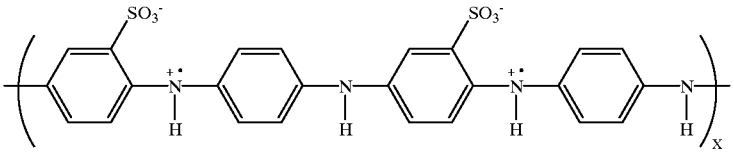

–: Negative Charge

+: Positive Charge

·: Electron wherein "X" can be 10 to 10,000.

SPAn is a "self-doped", electrically-conducting polymer, reported by Yue, Epstein and MacDiarmid in Proc. Symposium on Electroresponsive Molecular and Polymeric Systems, Brookhaven National Laboratory, October 1989, to have a conductivity of ~0.03 S/cm without external doping. Synthesis of the material is described in J.A.C.S. 1991, Vol 113, No 7 pp 2665–2671, exhibiting a conductivity of ~0.1 S/cm measured on pressed pellets. SPAn is not a highly conductive polymer. SPAn exhibits a conductivity of about seven orders of magnitude lower than that of metals such as silver; but the inventor herein has discovered that its unique morphology, when combined with PPD-T in the form of

DETAILED DESCRIPTION

Figure 1:
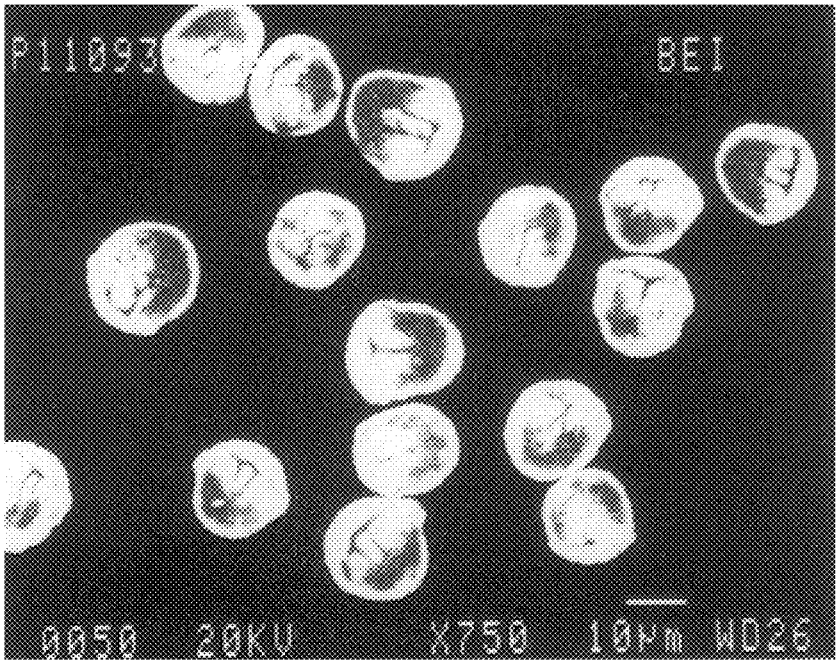
FIG. 1 shows a cross sectional electron backscattering photomicrograph of a fiber of the present invention wherein plating is conducted on a PPD-T/SPAn (w/w:90/10) fiber.

This invention provides electrically-conductive, composite fibers which exhibit high tenacity and high modulus. The primary organic components of these fibers are poly(p-phenylene terephthalamide) (PPD-T) and sulfonated polyaniline (SPAn). While the SPAn is somewhat electrically-composite fibers, facilitates electroless plating which yields strongly adherent silver. Once silver has activated the polymer, the polymer will readily accept other metals, such as copper and nickel , for strongly adherent deposition.

Up to this time, in order to have an electrolessly plated metal coating which was strongly adherent, it was believed that the PPD-T fiber surfaces had to be chemically treated to generate sites of activation for the plating process. In accordance with this invention, however, it has been discovered that the PPD-T fiber which contains SPAn does not require chemical treatment before plating.

It is believed that sulfonate groups on the SPAn in elongated SPAn domains which are dispersed as described in the PPD-T, provide enduring activation sites for plating processes. This sulfonation on the SPAn is believed to serve as activation sites for deposit of silver; and, because the SPAn is dispersed throughout the fiber, those sites are present throughout the PPD-T rather than only on the fiber surface. Moreover, sulfonation sites continue as activation sites through additional processing of the PPD-T and are not deactivated by contact with water or acid or other reactive materials, as happens with plating activators of the prior art.

It is believed that any amount of SPAn will improve the adhesion of silver to the composite fiber and enhance electrical conductivity; but that, below about 2 weight percent, based on the combined weight of the polymers, interconnection of SPAn domains along the fiber axis becomes much less. Higher amounts of SPAn render the composite fibers more amenable to silver adhesion for enhanced particle interconnection and electrical conductivity, but, above 40 percent, based on the combined weight of the polymers, reduction of mechanical properties and leaching of SPAn out of the composite fibers becomes excessive. For those reasons of practicality, it is preferred that the fibers of this invention should have a SPAn content of 2 to 35 weight percent, and preferably between 5 and 25 weight percent, based on combined weight of the polymers.

In the practice of this invention, high tenacity, high modulus PPD-T/SPAn fibers can be made by the procedure described in U.S. Pat. No. 5,549,972, issued Aug. 4, 1998. High tenacity and high modulus are specified in the range greater than 10 gpd and 150 gpd, respectively.

Fibers of this invention can be made by spinning a sulfuric acid solution of a mixture of PPD-T and SPAn into an aqueous coagulating bath to yield filaments of a coagulated combination of PPD-T and SPAn and then performing electroless plating on those filaments before all of the water has been removed. In the practice of this invention, the solution to be spun is prepared by dissolving PPD-T and polyaniline in the sulfuric acid solvent; and, during the course of dissolving, the polyaniline becomes sulfonated polyaniline (SPAn). The resulting coagulated filaments are termed "never-dried" fibers and use of such never-dried fibers is preferable in practice of this invention. Never-dried fibers may contain from 20 to as much as 120, or more, weight percent water and have never been dried to less than 20 weight percent water. While fibers which have been dried to a water content of less than 20 weight percent can also be plated in accordance with invention, such drying will have irreversibly collapsed the polymer structure of fiber, thereby severely reducing permeability thereof to activating ions and metal plating ions in subsequent processing steps.

Figure 2:
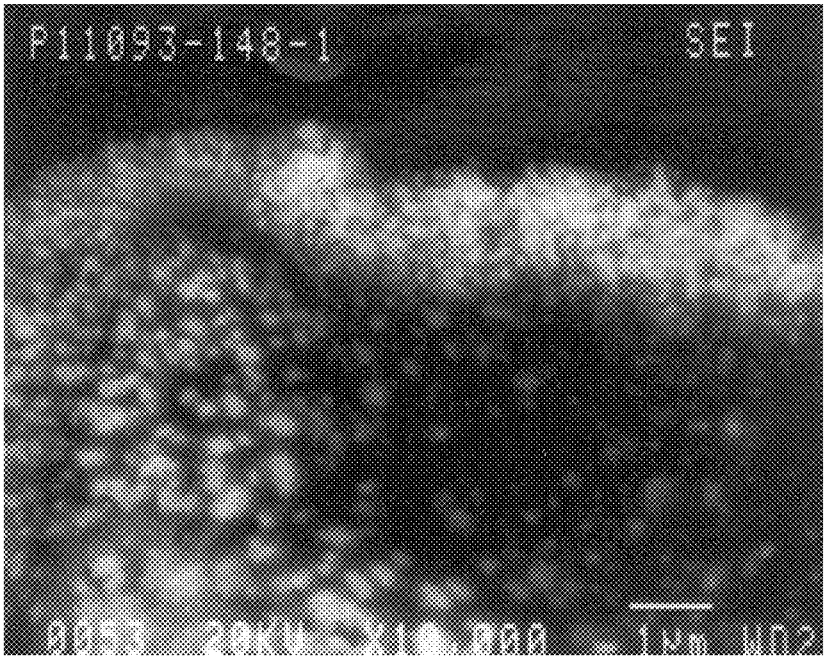
FIG. 2 shows the fiber of FIG. 1 at higher magnification.

By using never-dried composite fibers in practice of this invention, plating solutions can permeate and penetrate into the fiber and come into more direct contact with more sulfonic acid sites of the SPAn in the fibers. Thus, the preferred use of never-dried fibers to expose a below-the-surface portion of the fibers to the plating solution has been discovered to yield fibers having a foundation of PPD-T with interspersed domains of SPAn throughout the fibers and silver particles intermingled with those domains. The SPAn is aligned parallel with the fiber axis and the silver particles are located along the domains. The structural characteristic is illustrated in FIG. 1 which shows an electron backscattering photomicrograph of a fiber cross-section perpendicular to the fiber axis wherein plating is conducted on a "never-dried" PPD-T/SPAn (w/w:90/10) fiber. Bright spots throughout the entire plated fiber are silver particles intermingled with SPAn domains aligned parallel with the fiber axis. FIG. 2 shows the same cross-sectional view at higher magnification where the light spots are silver particles and the edge of the fiber is shown to have a high concentration of silver particles. The silver particles are interconnected and become an integral part of the composite fibers, thereby assuring strong adhesion to the PPD-T.

Silver is deposited as particles in the interior of the fiber and also, as a continuous coating or plated layer on the surface of the fiber. One of the surprising features of this invention resides in the discovery that the continuity of the coating or plated layer of silver is maintained through drying of the never-dried fibers even though the fibers may undergo substantial shrinkage during the course of drying.

When composite fibers are used which have been dried to less than 20 weight percent water, permeation of the plating solutions into the fibers is greatly reduced and formation of silver particles in the interior of the fiber is limited to a zone of impregnation inside but near to the surface of the fibers. Thickness of the zone of impregnation will be controlled by several factors, including the degree of initial fiber drying and the duration of contact with the plating solution. The zone of impregnation is a peripheral volume of composite fiber having silver particles intermingled with the SPAn domains whereby the silver particles serve as anchoring points for any silver coating or plating formed at the surface of the fiber. It is estimated that 10 to 30 weight percent silver, based on the total weight of the composite fibers, is enough silver to yield interconnected silver particles and plated layers for electrical conductivity. However, for maximum electrical conductivity, it is preferred to have 30 to 70 percent silver, based on the total weight of the composite fiber. Silver content of greater than 70 percent does not appreciably increase electrical conductivity and results in inefficient use of the silver with unnecessary addition of weight.

In further explanation of the operation of this invention, while the silver particles in the fibers are believed to anchor any silver coating on the fiber, sulfonate groups on the SPAn are believed to anchor the silver particles. The concentration of silver particles is a function of several factors, including degree of initial fiber dryness, duration of contact between the fibers and the plating solution concentration of the plating solution, and the like. While those factors are very important in the degree of impregnation, the rate of impregnation is somewhat self-limiting because, as the impregnation occurs, so, also, is the silver from the plating solution reduced to metallic silver, thereby, slowing further impregnation.

An early step of metal plating involves activation of plating sites. For an example of a silver plating, the fibers are first immersed in an aqueous reducing agent solution such as $SnCl_2$/HCl. The $SnCl_2$-treated fibers are then contacted with a metal complex solution of silver nitrate and ammonia at a pH of 8–9.5. During immersion in the metal complex bath, imbibed stannous ions reduce silver ions to silver metal on the polymer surface to thereby activate plating sites on the polymer. Once the polymer plating sites are activated, formaldehyde is added to the metal complex solution as a reducing agent and silver ions preferentially deposit on the silver-activated plating sites.

Alternatively, other metals such as, copper, nickel, cobalt, or the like can be plated on the silver-activated polymer surface with a proper reducing agent solution and metal plating solution.

TEST METHODS

Electrical conductivity:

The electrical conductivity of fibers without silver at ambient conditions is determined by a four probe method for calculation of electrical conductivity. A fiber specimen to be tested is about 1.5 cm long. Room temperature curing silver paste is used for making four electrodes on the fiber specimen. The two inner voltage measuring electrodes are about 8 mm apart.

Electrical current is applied to the two outer electrodes and the voltage corresponding to the known current is determined with a Keithley electrometer. Resistance is calculated based on Ohm's law. Conductivity in S(Siemen)/cm is calculated by normalization based on fiber cross-section and the distance between the voltage electrodes.

Electrical resistance:

Electrical resistance of silver-containing fiber is determined as follows: A fiber sample is attached with two pressure-contact probes. The two probes are one centimeter apart and are connected to a Keithley electrometer for determination of resistance. The resistance is reported as ohms per centimeter.

Tensile test:

Tenacity/Elongation/Modulus (T/E/M) of single filament at 1 inch gauge length and yarn at 5 inch gauge length are reported in grams per denier for T and M and in percent for E. The tenacity and elongation are determined according to ASTM 2101. Filament denier is determined according to ASTM D1577 using a vibroscope, and yarn denier is determined by weighing a 90 cm sample and multiplying the weight, in grams, by 10,000.

Sulfur element analysis:

Fiber sample is first combusted with oxygen in a flask. The generated $SO_2$ and $SO_3$ gases are absorbed in water. Hydrogen peroxide is added to insure that all sulfur is converted to sulfate. After boiling with platinum black to remove any excess $H_2O_2$, the pH is adjusted to 7. The solution is then added, in a 50/50 weight ratio with isopropanol, to water. That solution is titrated with a standardized $BaCl_2$ solution for determination of sulfate. The amount of sulfur is determined based on the sulfate concentration.

Inherent viscosity:

Inherent viscosity (IV) is defined by the equation:

$$IV = ln\ (\text{relative viscosity})/C$$

where C is the concentration (0.5 gram of polymer in 100 ml 96 W. % sulfuric acid) of the polymer solution and relative viscosity is the ratio between the flow times of the polymer solution and the solvent as measured at 30° C. in a capillary viscometer.

EXAMPLES

Example 1

Preparation of PPD-T/SPAN(90/10) fibers

Polyaniline was prepared according to the following method. A solution consisting of 134.3 g aniline, 194.4 g 37 weight percent HCl solution, and 1,350 g deionized water, were placed in a two liter jacketed glass reaction vessel with a nitrogen atmosphere. Under continuous agitation, the vessel contents were maintained at −3° C. while an oxidant solution consisting of 155 g ammonium persulfate in 270 g water was added at a rate of 1.95 ml/min using a syringe pump. Following addition of the oxidant solution, the reaction mixture was stirred at about −3° C. for 3.5 days. The vessel contents were then filtered and the collected polyaniline polymer powder was washed by repetitively slurrying in water and filtering, followed by vacuum-drying prior to being neutralized by re-slurrying the polymer in 0.15M ammonium hydroxide solution twice for 24 hours each time. The neutralized polymer was then dried and washed twice with 1.5 liters of methanol followed by a final wash with acetone. The polymer was dried and stored in a dry box until use. The polymer had an inherent viscosity of 1.29 measured at 30° C. as a 0.5 weight percent solution in 96.7 weight percent $H_2SO_4$ and was not electrically conductive because neutralization with ammonium hydroxide converted the polyaniline from the conductive form (emeraldine salt) to the insulating base form.

A 17 weight percent polyaniline/$H_2SO_4$ solution was prepared by adding 10.2 g of the polyaniline (base form), prepared as described above, to 49.8 g $H_2SO_4$ (100.15%) under a nitrogen blanket and chilled in a pre-dried glass vessel dry ice/acetone bath. The mixture was stirred vigorously with a spatula while being chilled in the dry ice/acetone bath; and was then transferred to a pre-dried twin cell having a cross-over plate for mixing (as described in Blades U.S. Pat. No. 3,767,756). The mixture was pushed back and forth through the cross-over plate for 2 hours at approximately 45° C. to obtain a homogeneous solution. 3.32 grams of the solution in the twin cells was transferred to a pre-dried glass bottle and was mixed with 0.81 g $H_2SO_4$ (100.15%) and 26.19 g of a 19.4 weight percent of PPD-T in $H_2SO_4$ (>100%) at room temperature under nitrogen to prepare a 18.6 weight percent spin dope having polyaniline/PPD-T weight ratio of 10:90 with the polyaniline dispersed in the PPD-T. The mixture was stirred at about 65° C. for 30 minutes and transferred to a 1 inch diameter twin cell where it was kept at 70° C. for 30 minutes and further mixed at 65° C. for 30 minutes by passing the mixture through a cross-over plate between cells to ensure a well dispersed system. A spin dope for comparison purposes was made using the same procedure as set out above but using only the PPD-T to make a solution of 18.6 weight percent polymer in the sulfuric acid.

The spin dopes containing 18.6 weight percent polymer were spun through an air gap according to the following procedure. In separate spinning operations, the spin dope solutions prepared above were transferred to one side of the twin cell and a filtration pack consisting of 200 and 325 mesh stainless steel screens and a dynalloy disc was inserted between the twin cell and a single-hole spinneret having a diameter of 3 mil and a length of 9 mil. The spinneret was located 0.25 inch above a one gallon glass container of ice-chilled deionized water. A threadline guide was placed 3 inches below the spinneret in the deionized water. The threadline traveled an additional 8 inches in the water before being wound up on a bobbin which was partially immersed in a deionized water containing tray. About 0.3 g of continuous filament sample was collected by extruding the spin dope at 300 pounds per square inch (psi) through the spinneret set at 80° C. with 200 ft/min wind-up speed. The continuous filament on the bobbin was immersed in 900 ml deionized water for one day immediately after the spinning.

The water was changed three times with fresh deionized water during that period. A portion of the fiber was dried thoroughly and the rest was kept in water. The dried fiber was tested for denier/tenacity/elongation/modulus and found to be 2.1/15.9 gpd/4.7%/329 gpd, respectively. The fiber contained 1.7 weight percent sulfur and had an electrical conductivity of 0.03 S/cm at ambient conditions. The results showed that the polyaniline was sulfonated during the processing in concentrated $H_2SO_4$ (>100 weight percent) at elevated temperatures.

Plating never-dried fibers.

About 0.1 gram each of the "never-dried" PPD-T/SPAn fiber of this invention and the "never-dried" PPD-T fiber for comparison, were back wound to form twenty loops 4 cm in diameter. The loops were then tied together to form "8 shaped" bundles. The twenty-filament bundles, while still wet, were immersed for 18 minutes in solutions containing 60 g deionized water, 1.5 g anhydrous stannous chloride and 3.3 ml of concentrated hydrochloric acid. The treated bundles were then immersed in three changes of deionized water for two minutes each. The thoroughly washed fiber bundles were immersed, at about 5° C. for 14 minutes in a solution containing 250 g deionized water, 2 g silver nitrate, about 1.5 ml of 30 W. % ammonium hydroxide, and 1 ml Stepanol® AEM, a wetting agent, sold by Stepan Company, Northfield, Ill., U.S.A.

When the bundles came into contact with the silver nitrate solution, the fibers turned very dark, indicating that silver ions were reduced by tin (+2) to form a high concentration of activation sites for subsequent silver electroless plating. At the end of the 14 minute period, 2 ml of aqueous 38 weight percent formaldehyde were added to carry out electroless silver plating. The plating was allowed to proceed for 28 minutes with periodic stirring of the plating solution. Each of the fiber bundles became metallic in appearance. They were washed thoroughly with water and then dried.

Figure 3:
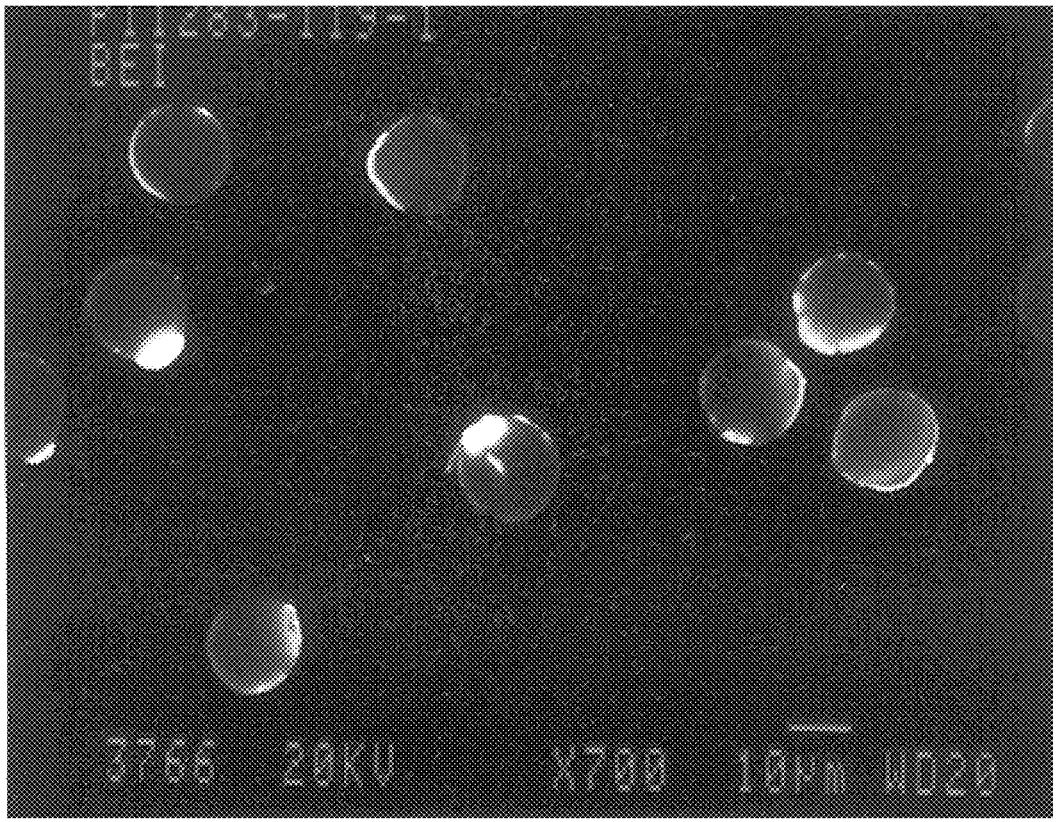
FIG. 3 shows a cross sectional electron backscattering photomicrograph of a fiber of the prior art wherein plating was conducted on a PPD-T fiber.

A small section cut from the 20 filament bundle of plated, never-dried, PPD-T/SPAn fibers of this invention exhibited an electrical resistance of 10.0 ohm/cm. Three filaments taken out individually from the 20 filament bundle exhibited electrical resistance of 0.24, 0.25, and 0.25 kilo-ohm/cm. The single filament resistances were quite consistent with the resistance of the 20 filament bundle, indicating that each filament was homogeneously plated. FIG. 1 is an electron backscattering micrograph of a cross section of the plated fiber of this invention showing that silver deposits both on the filament surface and in the fiber wherein silver particles commingle with domains of SPAn situated throughout the PPD-T. From FIG. 2, which is a more magnified view of a fiber from FIG. 1, it can be seen that silver particles are distributed throughout the entire fiber instead of as a continuous layer beneath the filament surface. The incorporation of silver inside the fiber is an important characteristic for silver adhesion to the fiber surface and in the fiber. Thermal gravimetric analysis showed that the plated fiber had 63.7 weight percent as a residue, indicating that the fiber contained about 64 weight percent silver. For comparison, the never-dried PPD-T fibers were silver plated in the same manner as above and were found to contain only 23 weight percent silver, and individual filaments were found to exhibit varied electrical resistances of 50, 35, and 40, and 3600 kilo-ohms/cm per filament. Resistance of the 20-filament bundle was 1.5 kilo-ohms/cm. FIG. 3 shows a cross sectional view of these comparison PPD-T fibers, revealing that what little silver is plated on the fibers is on the fiber surface.

Example 2

Plating Dried Fibers

About 0.1 gram each of the "never-dried" PPD-T/SPAn fibers and the "never-dried" PPD-T comparison fibers of Example 1, containing about 100 weight percent water, based on dry fiber weight, were formed into 20-filament "8 shaped" fiber bundles which were dried in air for five hours. The dried fiber bundles were then subjected to the silver-plating procedure described in Example 1, except that silver plating time was 35 minutes. The fibers were washed thoroughly with water and then air-dried. The PPD-T/SPAn fibers had a metallic luster and had 15 weight percent silver based on total weight of plated PPD-T/SPAn. The silver pick up was much lower than that of "never-dried" PPD-T/SPAn fibers prepared in Example 1, in spite of longer silver plating time, showing that silver particles form, intermingled with SPAn, on the surface and in a zone of impregnation not far below the surface of the fibers. Six filaments of the fibers of this invention were taken for resistance measurement and were found to have resistance of 0.8, 0.8, 0.7, 0.9, 0.8, and 0.9 kilo-ohm/cm. The PPD-T comparison fibers did not develop a metallic luster during the plating process and the fibers did not exhibit any weight gain as a result of the plating, indicating that the fibers contained no silver. Electrical resistance of the comparison filaments was greater than $10^5$ kilo-ohms/cm.

Results are summarized in the Table. From these examples, it can be seen that fibers of the PPD-T/SPAn are much more readily plated than fibers of PPD-T alone, whether in the "never-dried" form or not.

TABLE

| Exam. | Fiber | Plating Time (min) | Silver (%) | Filament Resistance (kilo-ohms/cm) |
|---|---|---|---|---|
| 1 | never-dried PPD-T/SPAn | 28 | 64 | 0.24; 0.25; 0.25 |
| 1-comp. | never-dried PPD-T | 35 | 23 | 50; 35; 40; 3,600 |
| 2 | dried PPD-T/SPAn | 35 | 15 | 0.8;0.8;0.7; 0.9;0.8;0.9 |
| 2-comp. | dried PPD-T | 35 | 0 | greater than $10^5$ |

What is claimed is:

1. A composite, silver-containing, fiber having a longitudinal axis, comprising a continuous phase of poly(p-phenylene terephthalamide) and, interspersed therein, domains of sulfonated polyaniline aligned substantially parallel with the longitudinal axis wherein the sulfonated polyaniline is present in an amount of 2 to 35 weight percent based on the combined weight of the sulfonated polyaniline and the poly(p-phenylene terephthalamide) and wherein silver particles are intermingled with the domains of sulfonated polyaniline and silver is present in an amount of 15 to 70 weight percent based on the total weight of the composite, silver-containing, fibers.

2. The composite fiber of claim 1 wherein the silver particles are interspersed throughout the entire fiber.

3. The composite fiber of claim 1 wherein the silver particles are present in a zone of impregnation at the surface of the fiber.

4. The composite fiber of claims 2 or 3 wherein there is a continuous layer of silver plated on the surface of the fiber.

5. The composite fiber of claim 1 wherein the sulfonated polyaniline and the poly(p-phenylene terephthalamide) are mutually insoluble.

* * * * *